US010570788B2

(12) United States Patent
Bennett et al.

(10) Patent No.: US 10,570,788 B2
(45) Date of Patent: Feb. 25, 2020

(54) OIL PAN ASSEMBLY

(71) Applicant: GM GLOBAL TECHNOLOGY OPERATIONS LLC, Detroit, MI (US)

(72) Inventors: Andy Bennett, Rochester Hills, MI (US); Sean M McGowan, Northville, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 185 days.

(21) Appl. No.: 15/798,654

(22) Filed: Oct. 31, 2017

(65) Prior Publication Data

US 2019/0128155 A1 May 2, 2019

(51) Int. Cl.
*F01M 11/00* (2006.01)

(52) U.S. Cl.
CPC ... *F01M 11/0004* (2013.01); *F01M 2011/002* (2013.01); *F01M 2011/005* (2013.01); *F01M 2011/007* (2013.01); *F01M 2011/0037* (2013.01); *F01M 2011/0041* (2013.01); *F01M 2011/0091* (2013.01)

(58) Field of Classification Search
CPC ..... F01M 11/0004; F01M 2011/002; F01M 2011/0041; F01M 2011/005; F01M 2011/0091
USPC ..... 184/106
See application file for complete search history.

(56) References Cited

U.S. PATENT DOCUMENTS 4,938,184 A * 7/1990 Martin ..... F01M 11/0004 123/195 C
5,465,692 A * 11/1995 Uraki ..... F01M 11/0004 123/195 C
5,960,908 A * 10/1999 Kasahara ..... F01M 11/0004 184/106
6,058,898 A * 5/2000 Freese ..... F01M 11/0004 123/195 C
6,705,270 B1 * 3/2004 Rau ..... F01M 11/0004 123/195 C
7,516,728 B1 * 4/2009 Staley ..... F01M 11/0004 123/195 C
7,938,095 B2 * 5/2011 Jessberger ..... F01M 11/0004 123/195 C
8,302,577 B2 * 11/2012 Wunsch ..... F01M 11/0004 123/195 C
2006/0118077 A1 6/2006 Hada et al.
2007/0221159 A1 * 9/2007 Tullis ..... F01M 11/0004 123/195 R
2007/0289569 A1 * 12/2007 Migaud ..... F01M 11/0004 123/195 C (Continued)

FOREIGN PATENT DOCUMENTS

CN 20470379 U 10/2015
JP 2008133902 A 6/2008

*Primary Examiner* — Michael R Mansen
*Assistant Examiner* — Mark K Buse
(74) *Attorney, Agent, or Firm* — Cantor Colburn LLP

(57) ABSTRACT

The oil pan assembly includes an oil pan and a slideable cover. The oil pan includes a base and a sidewall which surrounds the base wherein the base and the sidewall are configured to retain a pool of oil. The oil pan further includes a peripheral flange operatively configured to be coupled to an engine block. The slideable cover is affixed to the oil pan and is configured to maintain the pool of oil proximate to the base of the oil pan.

11 Claims, 5 Drawing Sheets

(56) References Cited

U.S. PATENT DOCUMENTS

| | | | | |
|---|---|---|---|---|
| 2010/0065014 | A1* | 3/2010 | Dos Santos | F01M 11/0004 123/196 R |
| 2010/0139606 | A1* | 6/2010 | Yorita | F01M 11/0004 123/192.2 |
| 2012/0067322 | A1* | 3/2012 | Andersson | F01M 11/0004 123/198 E |
| 2015/0300220 | A1* | 10/2015 | Mordukhovich | F01M 11/0004 184/106 |
| 2016/0319714 | A1* | 11/2016 | Shieh | F01M 11/0004 |
| 2016/0319715 | A1* | 11/2016 | Shieh | F01M 11/0004 |

* cited by examiner

OIL PAN ASSEMBLY

TECHNICAL FIELD

The present disclosure relates generally to vehicle engines, and in particular, a dynamic oil pan assembly used in vehicle engines.

BACKGROUND

Traditionally, automotive internal combustion engine design has evolved for application to vehicles with rear wheel drive and longitudinally mounted engines. The advent of front wheel drive vehicles led to the use of the traditional engine designs with minimal modifications for transverse mounting. For the oil return system, the oil pump for the longitudinally mounted engine has an oil intake near the rear of the oil pan. During vehicle forward acceleration the pool of oil in the pan surges to the rear of the pan so that the intake will be well supplied with oil. During braking the deceleration moves the oil toward the front of the pan such that the intake is no longer supplied with oil. Similarly, braking while turning at or about 1.5 G's (approximately 45 degree turns) may also expose the oil intake such that oil flow in the engine is disrupted.

Some front wheel drive vehicles with transversely mounted engines have the same oil pickup system as described above with the intake favoring the "rear" or left end of the pan. As shown in FIG. 1, the oil pan 110 contains an oil pump 112 which is attached to the engine, not shown, by a support 114, an oil intake 116 attached to the pump, and a windage baffle 118. A pool of oil 120 in the pan assumes a position determined by gravity and other forces. Such vehicles may experience a reduction of oil intake efficiency during aggressive left turns. This occurs because during the left turn the oil rushes to the front of the oil pan (front of the engine and toward the right side of the vehicle), as shown in FIG. 1, and no longer leaves the oil intake fully submerged in oil; then some air is entrained in the oil which is drawn into the oil pump—risking the loss of pump prime, bearing lubrication loss, and engine failure. The actual reduction in efficiency is a function of the G force on the oil. High performance vehicles can develop high turning acceleration on the order of 0.85 G's and this could result in the surface of the oil tilting at a 40° angle. Of course less severe turning acceleration results in a smaller angle.

A factor in the oil flow management in an oil pan is the windage baffle 118 which is a generally horizontal sheet of metal spaced from the side walls of the pan (with fixed openings at the sides as well as front and rear). The windage baffle 118 is interposed between the rapidly moving engine parts and the pool of oil 120 to prevent air currents from whipping up the oil and causing aeration. The windage baffle may also vacuum up oil and return the oil to the oil pan as aerated. Some of the oil returning to the pan from the engine runs down the sides of the crankcase past the baffle and some drips onto the baffle and runs over the edge to the bottom of the pan. When oil surges onto the top surface of the baffle 18 during a turn, the horizontal baffle impedes the return of the oil to the vicinity of the intake.

SUMMARY

Accordingly, the present disclosure provides an oil pan assembly which improves the oil pump efficiency in vehicles—particularly in performance sport cars and/or off-road. The oil pan assembly includes an oil pan and a slideable cover. The oil pan includes a base and a side wall which surrounds the base wherein the base and the sidewall are configured to retain a pool of oil. The oil pan further includes a peripheral flange operatively configured to be coupled to an engine block. The slideable cover is affixed to the oil pan and is configured to maintain the pool of oil proximate to the base of the oil pan.

The slideable cover includes an upper member defining a plurality of apertures and a lower member moveably affixed to the upper member. The lower member is configured to block at least a portion of at least one aperture in the plurality of apertures at all times as vehicle dynamic loads are applied to the upper and lower members.

A plurality of brackets may be affixed to the upper member via mechanical fasteners, spot welds or the like. The plurality of brackets are configured to couple the upper member to the lower member wherein the lower member rests upon a small portion (toward the lateral end) of each bracket in the plurality of brackets. Given that a very small portion of the surface area of the lower member is in contact with each bracket, very little friction/resistance is experienced by the lower member as it moves relative to the upper member and the brackets. Accordingly, the lower member moves in a substantially free manner in second direction as the vehicle (and the upper member) makes sudden movements (fore, aft, left, right, diagonal, etc) in a first direction. The second direction is generally the opposite direction of the (sudden) first direction due to the G-force of the second member. Accordingly, when the vehicle suddenly moves forward via acceleration, the lower member slides rearward relative to the upper member due to the G-force of the lower member. Likewise, when the vehicle suddenly moves rearward or decelerates, the lower member slides forward relative to the upper member due to the G-force of the lower member. Also, when the vehicle suddenly turns left, the lower member slides right relative to the upper member due to the G-force of the lower member. Similarly, when the vehicle suddenly turns right, the lower member slides left relative to the upper member due to the G-force of the lower member. Moreover, when the vehicle suddenly moves in a first diagonal direction (via partial turn or rough terrain), the lower member slides in a second (opposite) diagonal direction relative to the upper member due to the G-force of the lower member when the hard-braking turns or hard-accelerating turns are taken by the vehicle.

The present disclosure and its particular features and advantages will become more apparent from the following detailed description considered with reference to the accompanying drawings.

BRIEF DESCRIPTION OF THE DRAWINGS

These and other features and advantages of the present disclosure will be apparent from the following detailed description, best mode, claims, and accompanying drawings in which:

Like reference numerals refer to like parts throughout the description of several views of the drawings.

DETAILED DESCRIPTION

Figure 1:
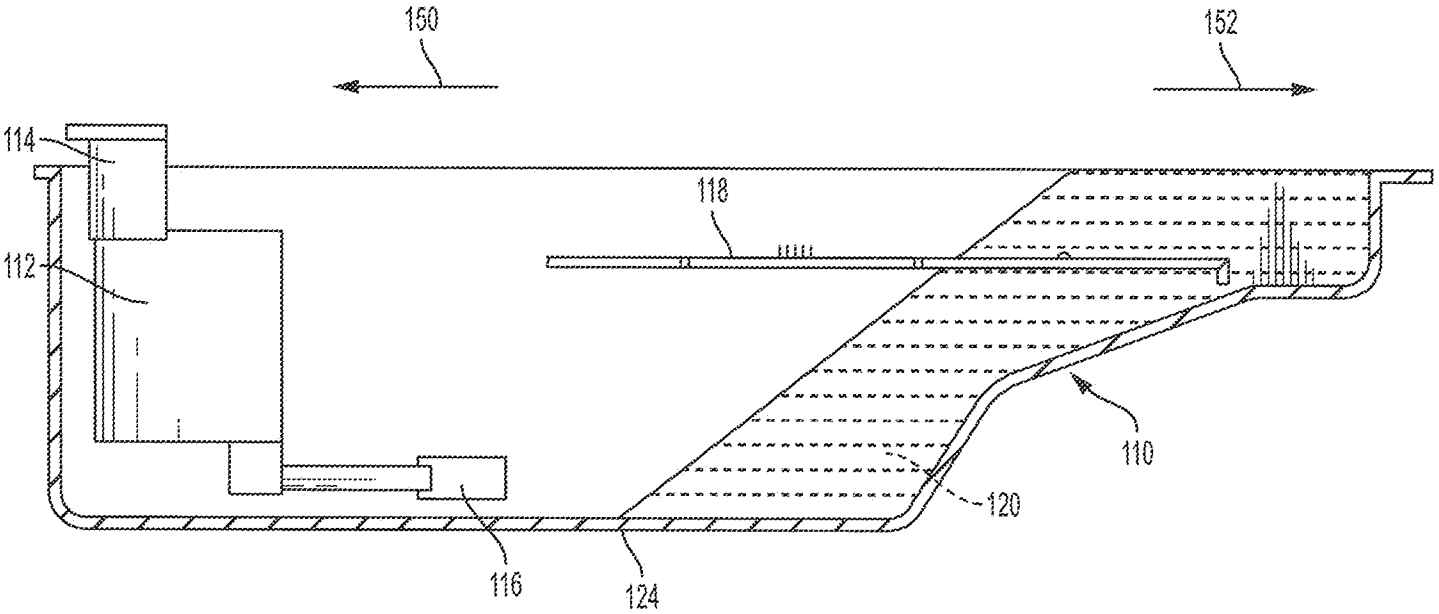
FIG. 1 illustrates a traditional oil pan with a baffle.

Reference will now be made in detail to presently preferred compositions, embodiments and methods of the present disclosure, which constitute the best modes of practicing the present disclosure presently known to the inventors. The figures are not necessarily to scale. However, it is to be understood that the disclosed embodiments are merely exemplary of the present disclosure that may be embodied in various and alternative forms. Therefore, specific details disclosed herein are not to be interpreted as limiting, but merely as a representative basis for any aspect of the present disclosure and/or as a representative basis for teaching one skilled in the art to variously employ the present disclosure.

Except in the examples, or where otherwise expressly indicated, all numerical quantities in this description indicating amounts of material or conditions of reaction and/or use are to be understood as modified by the word "about" in describing the broadest scope of the present disclosure. Practice within the numerical limits stated is generally preferred. Also, unless expressly stated to the contrary: percent, "parts of," and ratio values are by weight; the description of a group or class of materials as suitable or preferred for a given purpose in connection with the present disclosure implies that mixtures of any two or more of the members of the group or class are equally suitable or preferred; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

It is also to be understood that this present disclosure is not limited to the specific embodiments and methods described below, as specific components and/or conditions may, of course, vary. Furthermore, the terminology used herein is used only for the purpose of describing particular embodiments of the present disclosure and is not intended to be limiting in any manner.

It must also be noted that, as used in the specification and the appended claims, the singular form "a," "an," and "the" comprise plural referents unless the context clearly indicates otherwise. For example, reference to a component in the singular is intended to comprise a plurality of components.

The term "comprising" is synonymous with "including," "having," "containing," or "characterized by." These terms are inclusive and open-ended and do not exclude additional, unrecited elements or method steps.

The phrase "consisting of" excludes any element, step, or ingredient not specified in the claim. When this phrase appears in a clause of the body of a claim, rather than immediately following the preamble, it limits only the element set forth in that clause; other elements are not excluded from the claim as a whole.

The phrase "consisting essentially of" limits the scope of a claim to the specified materials or steps, plus those that do not materially affect the basic and novel characteristic(s) of the claimed subject matter.

The terms "comprising", "consisting of", and "consisting essentially of" can be alternatively used. Where one of these three terms is used, the presently disclosed and claimed subject matter can include the use of either of the other two terms.

Throughout this application, where publications are referenced, the disclosures of these publications in their entireties are hereby incorporated by reference into this application to more fully describe the state of the art to which this present disclosure pertains.

The following detailed description is merely exemplary in nature and is not intended to limit the present disclosure or the application and uses of the present disclosure. Furthermore, there is no intention to be bound by any theory presented in the preceding background or the following detailed description.

Figure 2:
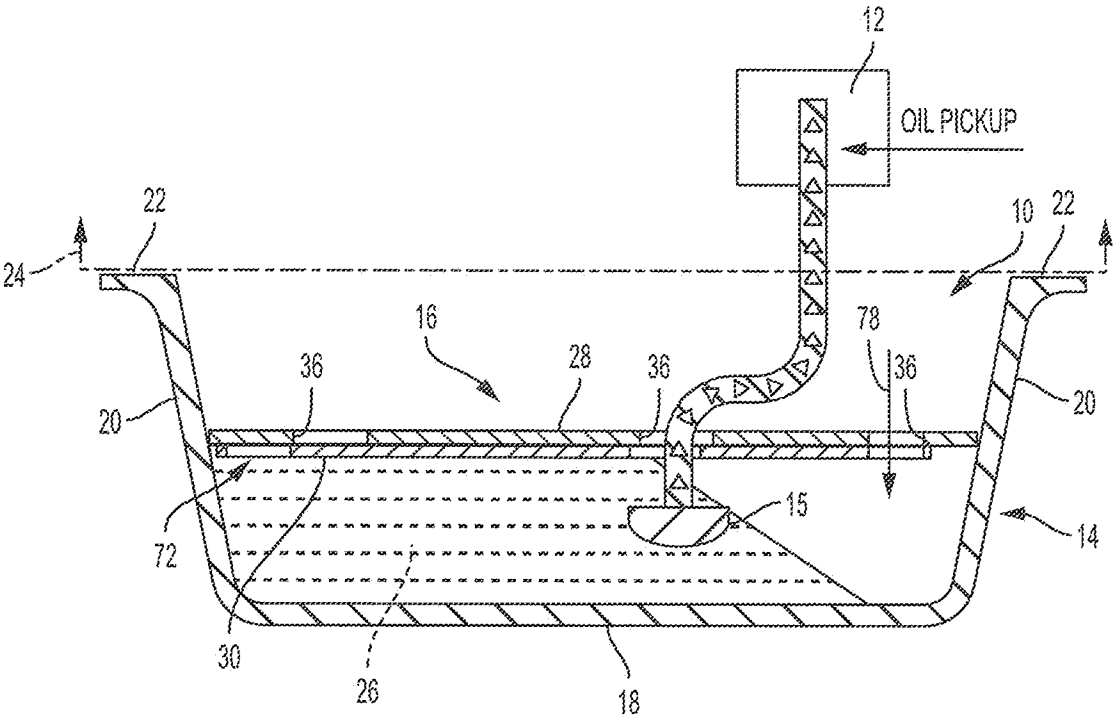
FIG. 2 illustrates a cross-sectional side schematic view of the oil pan assembly of the present disclosure.

With reference to FIG. 2, the present disclosure provides an oil pan assembly 10 which improves the oil pump 12 efficiency. The oil pan assembly 10 includes an oil pan 14 and a slideable cover 16. The oil pan 14 includes a base 18 and a sidewall 20 which surrounds the base 18 wherein the base 18 and the sidewall 20 are configured to retain a pool of oil 26. The oil pan 14 further includes a peripheral flange 22 operatively configured to be coupled to an engine block 24. The slideable cover 16 is affixed to the oil pan 14 and is configured to maintain the pool of oil 26 proximate to the base 18 of the oil pan 14.

Figure 3:
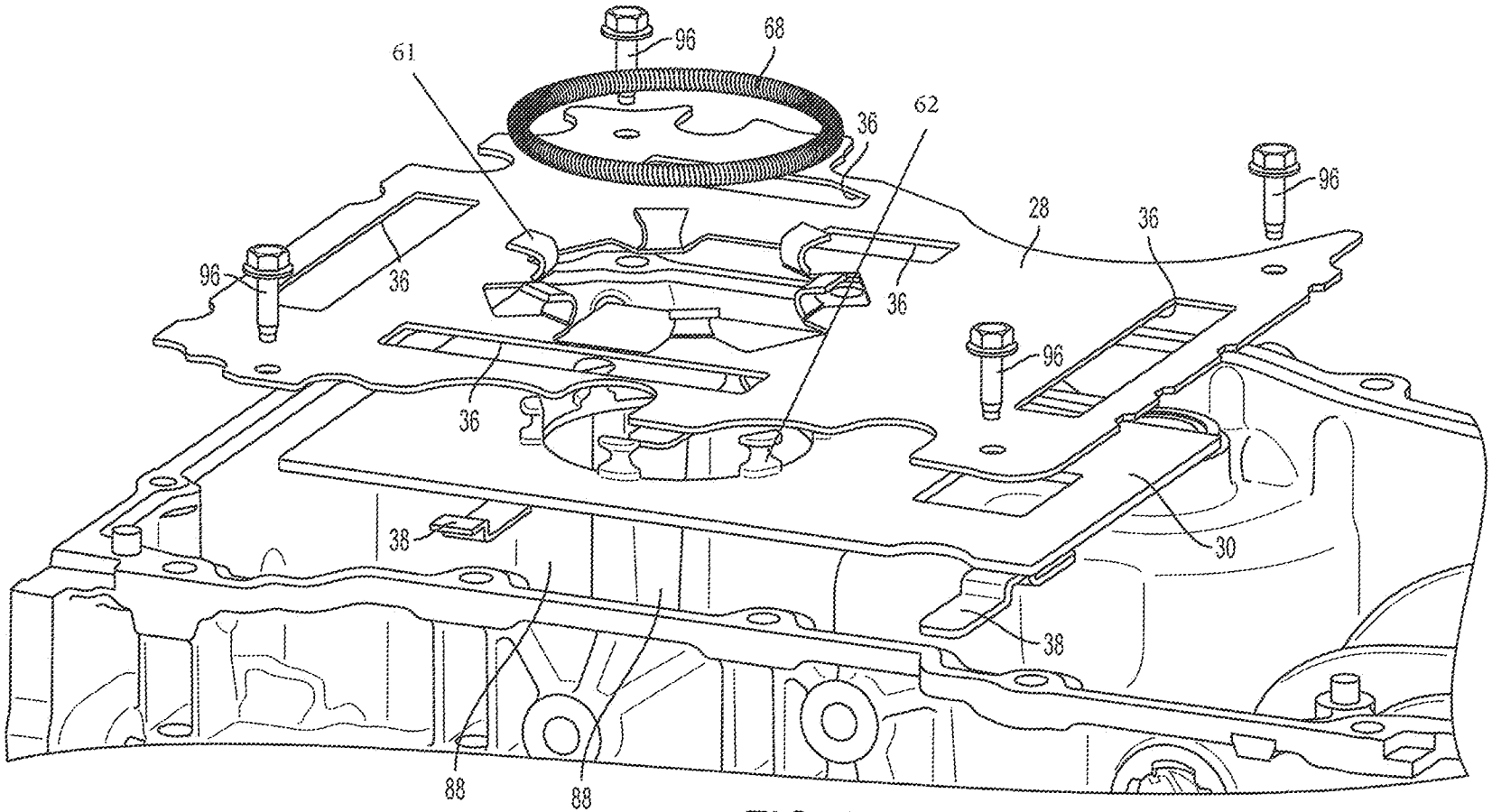
FIG. 3 illustrates an expanded partial isometric view of the oil pan assembly of the present disclosure.
Figure 4:
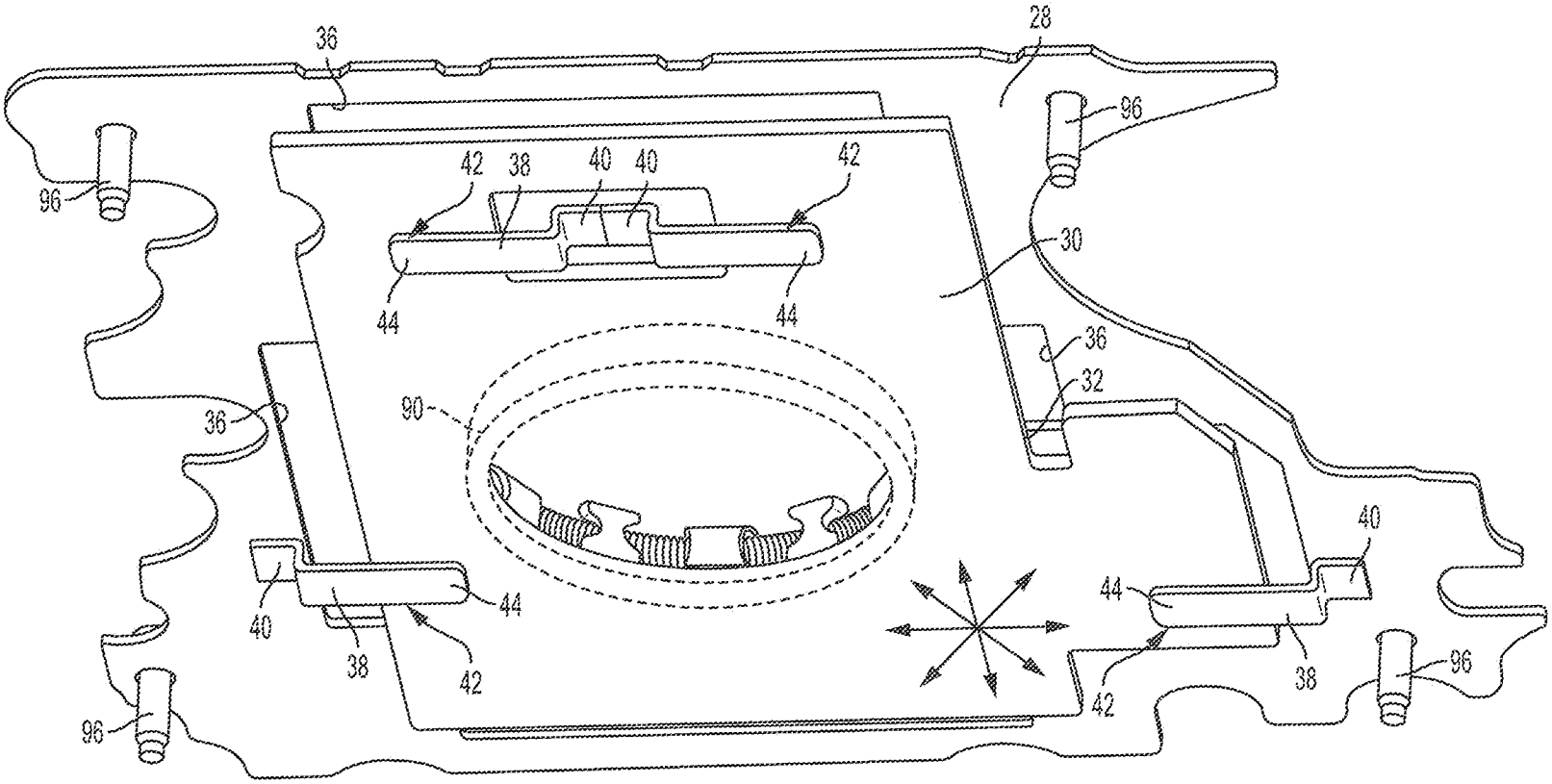
FIG. 4 illustrates an isometric view of the underside of the oil pan cover of the present disclosure.
Figure 5:
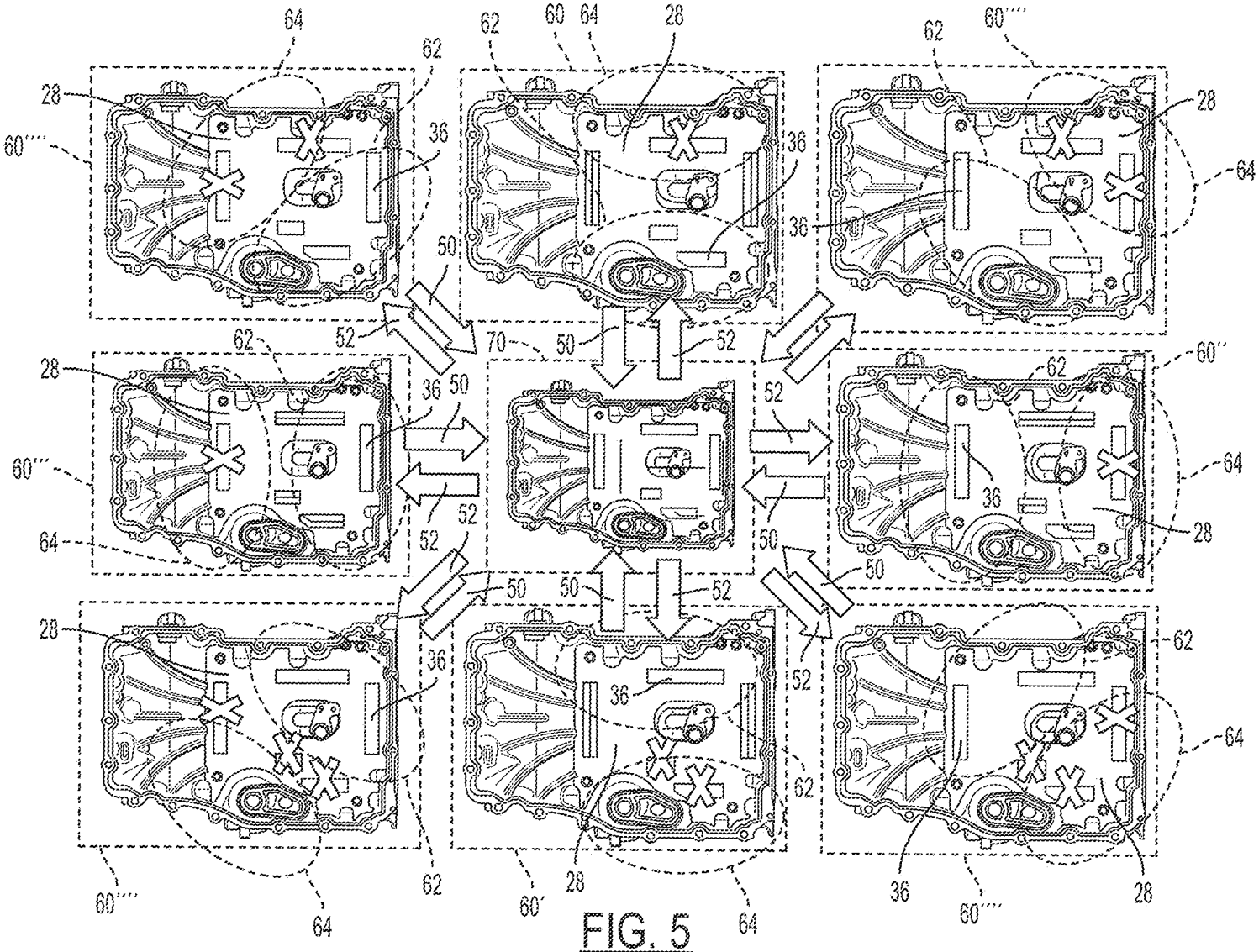
FIG. 5 illustrates the eight different positions of the oil pan assembly of the present disclosure under various vehicle dynamic loads.

As shown in FIGS. 2-4, the slideable cover 16 includes an upper member 28 defining a plurality of aperture 36*s* and a lower member 30 moveably affixed to the upper member 28. The upper member 28 may be affixed to the oil pan 14 via mechanical fasteners 96 (FIGS. 3 and 4). With reference to FIGS. 4 and 5, the lower member 30 is configured to block at least a portion of at least one aperture 36 in the plurality of apertures 36 at all times as vehicle dynamic loads are applied to the upper and lower member 28, 30. The length and/or width of the lower member 30 may be less than the length and/or width of the upper member 28. The lower member 30 may also define a recess 32 so that an aperture 36 of the upper member 28 may be exposed to the base 18 under certain conditions.

As shown in FIG. 4, a plurality of brackets 38 may be affixed to the upper member 28 via mechanical fasteners 40, spot welds 40 or the like. The plurality of brackets 38 are configured to couple the upper member 28 to the lower member 30 wherein the lower member 30 rests upon a small portion 42 (toward the lateral end 44) of each bracket 38 in the plurality of brackets 38. The small portion 42 may, but not necessarily, be in the form of a spherical bump with a low friction contact point. Given that a very small portion of the lower member 30 is in contact with each bracket 38, very little friction/resistance is experienced by the lower member 30 as it moves relative to the upper member 28 and the brackets 38. Accordingly, the lower member 30 moves in a substantially free manner in second direction 52 as the vehicle (and the upper member 28) makes sudden movements (fore, aft, left, right diagonal, etc.) in a first direction 50. The second direction 52 is generally the opposite direction of the (sudden) first direction 50 as shown in FIG. 5 due to the G-force of the second member 30. Accordingly, when the vehicle (upper member) 28 suddenly moves forward (first direction 50) via acceleration (see oil pan assembly 60 in FIG. 5), the lower member 30 slides rearward (second direction 52) relative to the upper member 28 due to the G-force of the lower member 30. Likewise, when the vehicle (and upper member 28) suddenly moves rearward in first direction 50 (see oil pan assembly 60' in FIG. 5), the lower member 30 slides forward (second direction 52) relative to the upper member 28 (moving in first direction 50) due to the G-force of the lower member 30. Also, when the vehicle suddenly turns left in first direction 50 (see oil pan assembly 60" in FIG. 5), the lower member 30 slides right (second direction 52) relative to the upper member 28 (moving in first direction 50) due to the G-force of the lower member 30. Similarly, when the vehicle suddenly turns right (see oil pan assembly 60''' in FIG. 5), the lower member 30 slides left (second direction 52) relative to the upper member 28 (moving in first direction 50) due to the G-force of the lower member 30. Moreover, when the vehicle suddenly moves in a first diagonal direction 50 via partial turn or rough terrain (see oil pan assembly 60'' in FIG. 5), the lower member 30 slides in a second (opposite) diagonal direction 52 relative to the upper member 28 (moving in first direction 50) due to the G-force of the lower member 30. It is noted that oil pan assembly 70 in FIG. 5 illustrates the position of the upper member relative to the lower member when the vehicle is at rest and is not experiencing any sudden movement. A biasing member 68 (FIG. 3) may maintain the lower member 30 in a central position relative to the upper member 28 such that each aperture 36 in the plurality of apertures 36 in the upper member 28 are partially open.

With reference to FIGS. 2 and 5, as the lower member 30 moves relative to the upper member 28, the lower member 30 is configured to retain the pool of oil 26 proximate to the base 18 of the oil pan 14 when the vehicle suddenly moves while simultaneously providing a path (via exposed apertures 36 of upper member) for new engine oil 78 (FIG. 2) to flow to the base 18 of the oil pan 14. The lower member 30, together with the upper member 28, provides a horizontal surface 72 to function as an upper boundary 72 for the pool of oil 26 within the oil pan 14 as the pool of oil 26 also moves in the second direction 52 due to G-force. When the lower member 30 moves in the second direction 52, the lower member 30 closes at least one aperture 36 in the secondary region 64 of the upper member 28 by blocking off the at least one aperture 36 in the secondary region 64. It is understood that the secondary region 64 of the upper member 28 is the area of the upper member 28 which is located in the direction (most) opposite of the sudden vehicle movement. The primary region 62 of the upper member 28 is the area of the upper member 28 which is located closest to the direction of the sudden vehicle movement. As shown in the traditional oil pan 110 of FIG. 1, the pool of oil 120 in a traditional oil pans 110 may freely move in the second opposite 152 direction of sudden vehicle movement in the first direction 150. The pool of oil 130 in FIG. 1 tends to move up and away from the base 124 of the oil pan 14 thereby exposing a substantial portion of the base 124 to air and/or further exposing the oil intake 116 to air which may damage the oil pump 112 and also disrupt the much needed continuous flow of oil to the engine.

Accordingly, as shown in FIG. 5, as the lower member 30 of the present disclosure slides relative to the upper member 28, the lower member 30 is configured to open apertures 36 in primary regions 62 of the upper member 28 while simultaneously blocking apertures 36 in secondary regions 64 of the upper member 28 upon movement relative to the upper member 28. As noted the second member 30 may block at least one aperture 36 in a secondary region 64 and upon movement, the lower member may unblock or uncover at least one aperture 36 in a primary region 62. In doing so, the engine components may be in fluid communication with the base 18 of the oil pan 14 via the exposed aperture(s) 36 in the primary region 62—thereby allowing the oil pan 14 to continue to collect new engine oil 78 (FIG. 2) while also keeping the oil intake 15 submerged in the pool of oil 26 despite sudden vehicle movement.

It is also understood that the sidewall 20 of the oil pan 14 may optionally include a plurality of stops configured to maintain the longitudinal and lateral angles of the lower member 30 within a predetermined range such that the lower member 30 substantially maintains its angular orientation with respect to the plurality of brackets 38 and/or upper member 28 and/or sidewall 20 of the oil pan 14.

With further reference to FIG. 4, the oil pan assembly 10 of the present disclosure may further include an optional biasing member 68 such as a spring 68 which is configured to couple the upper member 28 to the lower member 30. As shown in FIG. 3, the biasing member (or spring) 68 may be retained in upper tabs 61 defined in the upper member 28 as well as in lower tabs 62 defined in the lower member 30. The flexibility in the biasing member 68 allows the lower member 30 to move relative to the upper member 28. It is understood that the biasing member 68 should also have a spring rate which is low enough to enable the lower member 30 to easily move relative to the upper member 28 when the vehicle makes sudden movements in any direction. In FIG. 3, the example biasing member 68 which has a circular configuration enables the lower member 30 to freely move in any direction relative to the upper member 28—and restore the lower member to its original central position/arrangement (element 70 in FIG. 5). As shown in FIG. 4, the brackets 38 may each include at least one vertical surface which functions as a stop to prevent the lower member from sliding too far in any particular direction and/or hitting the sidewall of the oil pan.

It is further understood that the lower member 30 may be formed from a lightweight metal or may be formed from a polymeric material. However, the lower member 30 should have sufficient mass such that the lower member 30 has sufficient G-force to move in the second direction 52 when the vehicle (and upper member 28) move in the first direction 50—opposite of the second direction 52. Additional mass to the lower member 30 may be added by increasing the thickness of the lower member 30 or by adding lower member flange 90 as shown in FIG. 4. Accordingly, the oil pan assembly 10 includes a slideable cover 16 affixed to an oil pan 14 having a base 18, a sidewall 20, and a peripheral flange 22 operatively configured to be coupled to an engine block 24.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. An oil pan assembly for a vehicle comprising:

an oil pan having a base and a sidewall configured to retain a pool of oil in addition to a peripheral flange operatively configured to be coupled to an engine block; and a slideable cover affixed to the oil pan, wherein the slideable cover includes an upper member defining a plurality of apertures and a lower member moveably affixed to the upper member.

2. The oil pan assembly of claim 1 wherein the lower member is configured to block at least a portion of at least one aperture in the plurality of apertures at all times.

3. The oil pan assembly of claim 2 wherein the lower member slides relative to the upper member upon sudden movement of the vehicle.

4. The oil pan assembly of claim 3 wherein the lower member is operatively configured to retain the pool of oil proximate to the base of the oil pan when the vehicle suddenly moves while simultaneously provide a path for new engine oil to be retained at the base of the oil pan.

5. The oil pan assembly of claim 4 wherein the lower member is configured to open different regions of the upper member while simultaneously closing other regions of the upper member upon movement relative to the upper member.

6. The oil pan assembly of claim 5 wherein a plurality of brackets are affixed to the upper member and the plurality of brackets couple the upper member to the lower member.

7. The oil pan assembly of claim 6 wherein the lower member rests upon a portion of each bracket in the plurality of brackets.

8. The oil pan assembly of claim 7 further comprising a spring coupling the upper member to the lower member.

9. The oil pan assembly of claim 8 wherein the spring is configured to pull the lower member to a central position while allowing a flow of new engine oil to move from the engine to the base of the oil pan.

10. The oil pan assembly of claim 6 wherein the sidewall includes a plurality of stops configured to maintain the longitudinal and lateral angles of the lower member within a predetermined range.

11. The oil pan assembly of claim 10 wherein the lower member is formed from a polymeric material.

* * * * *